US005271104A

United States Patent [19]

LaTora

[11] Patent Number: 5,271,104

[45] Date of Patent: Dec. 21, 1993

[54] TOILET BIDET

[76] Inventor: Salvatore C. LaTora, P.O. Box 14634, Santa Rosa, Calif. 95402

[21] Appl. No.: 869,546

[22] Filed: Apr. 15, 1992

[51] Int. Cl.[5] ..... A61H 35/00

[52] U.S. Cl. ..... 4/420.4; 4/443; 4/447; 4/448

[58] Field of Search ..... 4/420.1, 420.2, 420.4, 4/448, 447, 446, 445, 444, 443, 420.3, 420.5, 447

[56] References Cited

U.S. PATENT DOCUMENTS

| | | | |
|---|---|---|---|
| 119,973 | 10/1918 | Shank | 4/420.5 |
| 3,462,766 | 8/1969 | Merkel | 4/420.2 |
| 3,570,015 | 3/1971 | Rosengaus | 4/420.4 |
| 3,781,919 | 1/1974 | Ayala | 4/447 |
| 3,808,608 | 5/1974 | Caplan | 4/448 |
| 4,123,807 | 11/1978 | Oguma et al. | 4/448 |
| 4,327,451 | 5/1982 | Baus | 4/420.4 X |
| 4,833,739 | 5/1989 | Sakakibara et al. | 4/524 |
| 5,090,067 | 2/1992 | Cogdill | 4/420.2 |
| 5,142,711 | 9/1992 | Parikh | 4/420.4 |

*Primary Examiner*—Henry J. Recla
*Assistant Examiner*—Charles R. Eloshway
*Attorney, Agent, or Firm*—Larry D. Johnson

[57] ABSTRACT

A toilet bidet provides a cold water supply hose for attachment to an existing toilet's filler tube, may include a heating unit mounted to the side of the existing toilet tank, a water delivery hose leading to a bracket housing mounted on the rim of the existing toilet bowl, and a pivotable bidet arm directing the water upwards through a bidet nozzle towards the center of the toilet bowl. The heating unit is activated by a tank-mounted switch having a float switch or switch arm extending beneath the existing toilet's float arm, so that each time the toilet is flushed, and the float arm falls with the dropping water level in the tank, the float switch or switch arm is depressed, thereby activating the heating unit.

2 Claims, 4 Drawing Sheets

TOILET BIDET

BACKGROUND OF THE INVENTION

1. Field of the Invention

This invention relates generally to household plumbing and related fixtures, and more specifically to an improved bidet apparatus for connection to standard toilet fixtures.

2. Description of the Prior Art

Toilet fixtures and bidets are well known. Most known bidets are stand-alone units, requiring additional bathroom floor space and appropriate separate plumbing to install. As an alternative, some designers have developed portable bidet units that can be used in conjunction with an existing toilet. However, these portable units are typically bulky and awkward to use, and still require supplemental plumbing to install. Other known portable units have a self-contained water supply, but these generally require constant heating of the water for spontaneous use, and repetitive refilling of the water reservoir for continued use.

SUMMARY OF THE INVENTION

The toilet bidet of this invention provides a bidet apparatus suitable for retrofit installation to existing toilet fixtures, or original installation into manufactured fixtures. The toilet bidet comprises a cold water supply hose conditioned for attachment to an existing toilet's filler tube, and may include a battery or household-current powered heating unit mounted to the side of the existing toilet tank, a (warm) water delivery hose leading to a bracket housing mounted on the rim of the existing toilet bowl, and a pivotable bidet arm directing the water upwards through a bidet nozzle towards the center of the toilet bowl.

The optional heating unit is activated by a tank-mounted switch having a float switch or switch arm extending beneath the existing toilet's float arm (which connects to the existing toilet's float ball), so that each time the toilet is the tank, the float switch or switch arm is depressed, thereby activating the heating unit. At the same time, water from the toilet's filler tube, which normally would be directed to the toilet tank's overflow tube, is instead delivered through the bidet's cold water supply hose to the heating unit where it is warmed, and thence through the bidet's water delivery hose to the bidet arm and nozzle for delivery to the user. The bidet arm and nozzle are pivotally mounted so that they normally rest against the side of the toilet bowl, but pivot towards the center of the bowl upon water delivery.

After flushing, the toilet tank refills with water, raising the float switch (or the float arm and the switch arm) to turn off the heating unit. At the same time, the existing toilet's ball-cock assembly automatically stops the water flowing through the toilet's filler tube, and thus no water is delivered to the heating unit or bidet arm/nozzle, so the bidet arm returns to its original position adjacent the toilet bowl.

Thus, the toilet bidet of this invention does not require connection to a hot water line, nor (in the case of battery operation of the heating unit) connection to an outside power supply. In addition, the toilet bidet uses only the water that would normally be directed to the toilet tank's overflow tube, thereby saving water. Furthermore, the power to the toilet bidet's heating unit is on only when the toilet is actually flushing, thereby saving power as well.

DETAILED DESCRIPTION OF A PREFERRED EMBODIMENT

Figure 1:
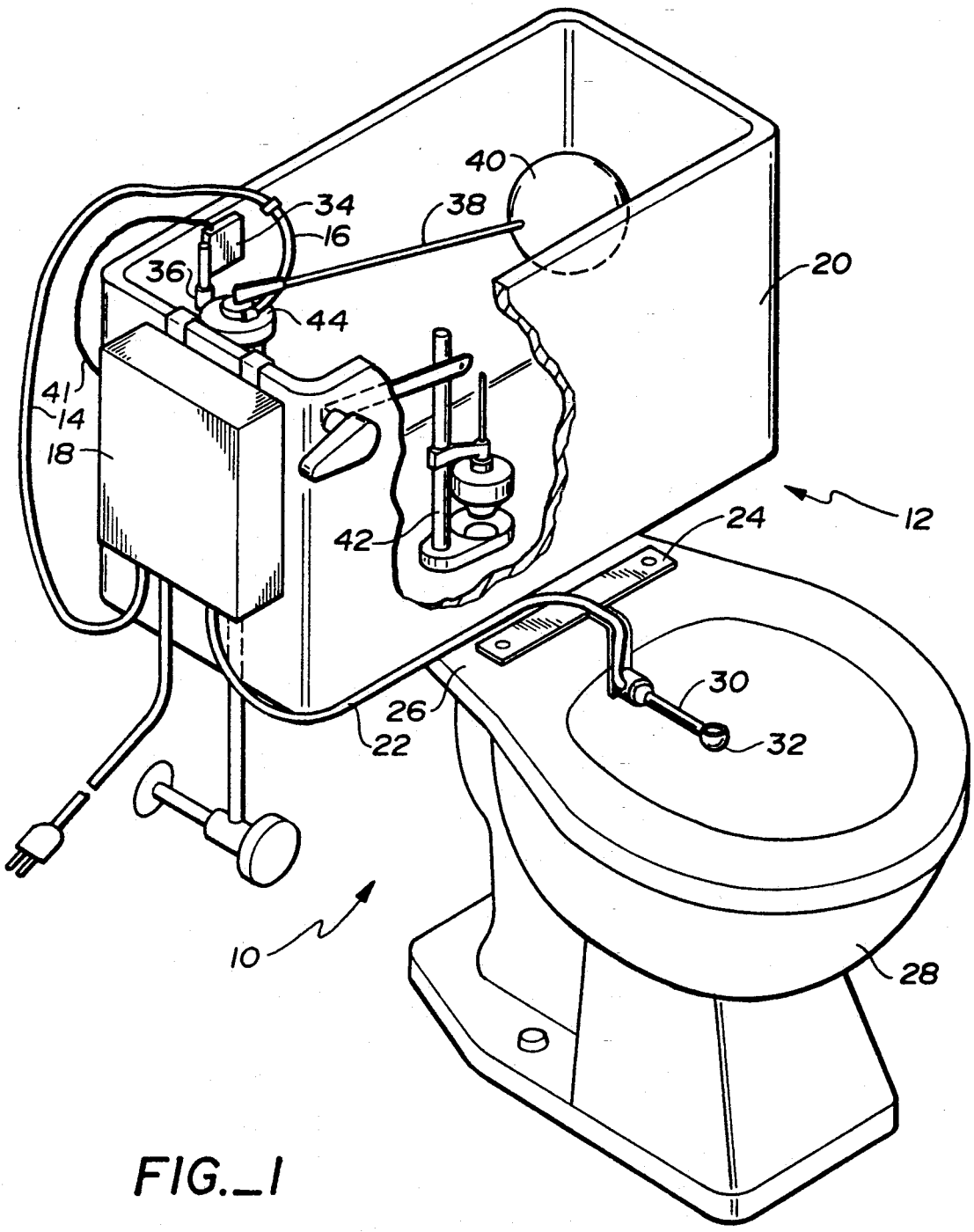
FIG. 1 is a perspective view of a toilet bidet of this invention as installed on a standard toilet fixture.

FIG. 1 is a perspective view of a toilet bidet 10 of this invention as installed on a standard toilet fixture 12. The toilet bidet comprises a cold water supply hose 14 (e.g., five-sixteenths inch plastic hose) conditioned for attachment to an existing toilet's filler tube 16, a battery or household-current powered heating unit 18 (including, for example, straight or curved quick-heating elements) mounted to the side of the existing toilet tank 20, a warm water delivery hose 22 (e.g., five-sixteenths inch plastic hose) leading to a bracket housing 24 mounted on the rim 26 of the existing toilet bowl 28, and a pivotable bidet arm 30 directing the warm water upwards through a bidet nozzle 32 towards the center of the toilet bowl. The heating unit is activated by a tank-mounted switch 34 (e.g., a microswitch) having a float switch 36 extending beneath the typical tank full water level (alternatively, the switch 34 could the existing toilet's float arm 38 which connects to the existing toilet's float ball 40) and connected to the heating unit by lead 41, so that each time the toilet is flushed, and the float switch falls with the dropping water level in the tank, the switch activates the heating unit. At the same time, water from the toilet's filler tube, which normally would be directed to the toilet tank's overflow tube 42, is instead delivered through the bidet's cold water supply hose 14 to the heating unit 18 where it is warmed, and thence through the bidet's warm water delivery hose 22 to the bidet arm 30 and nozzle 32 for delivery to the user. The bidet arm and nozzle are pivotally mounted so that they normally rest against the side of the toilet bowl 28, but pivot towards the center of the bowl upon warm water delivery.

After flushing, the toilet tank refills with water, raising the float switch 36 to turn off the heating unit. At the same time, the existing toilet's ball-cock assembly 44 automatically stops the water flowing through the toilet's filler tube, and thus no water is delivered to the heating unit or bidet arm/nozzle, so the bidet arm returns to its original position adjacent the toilet bowl.

Figure 2:
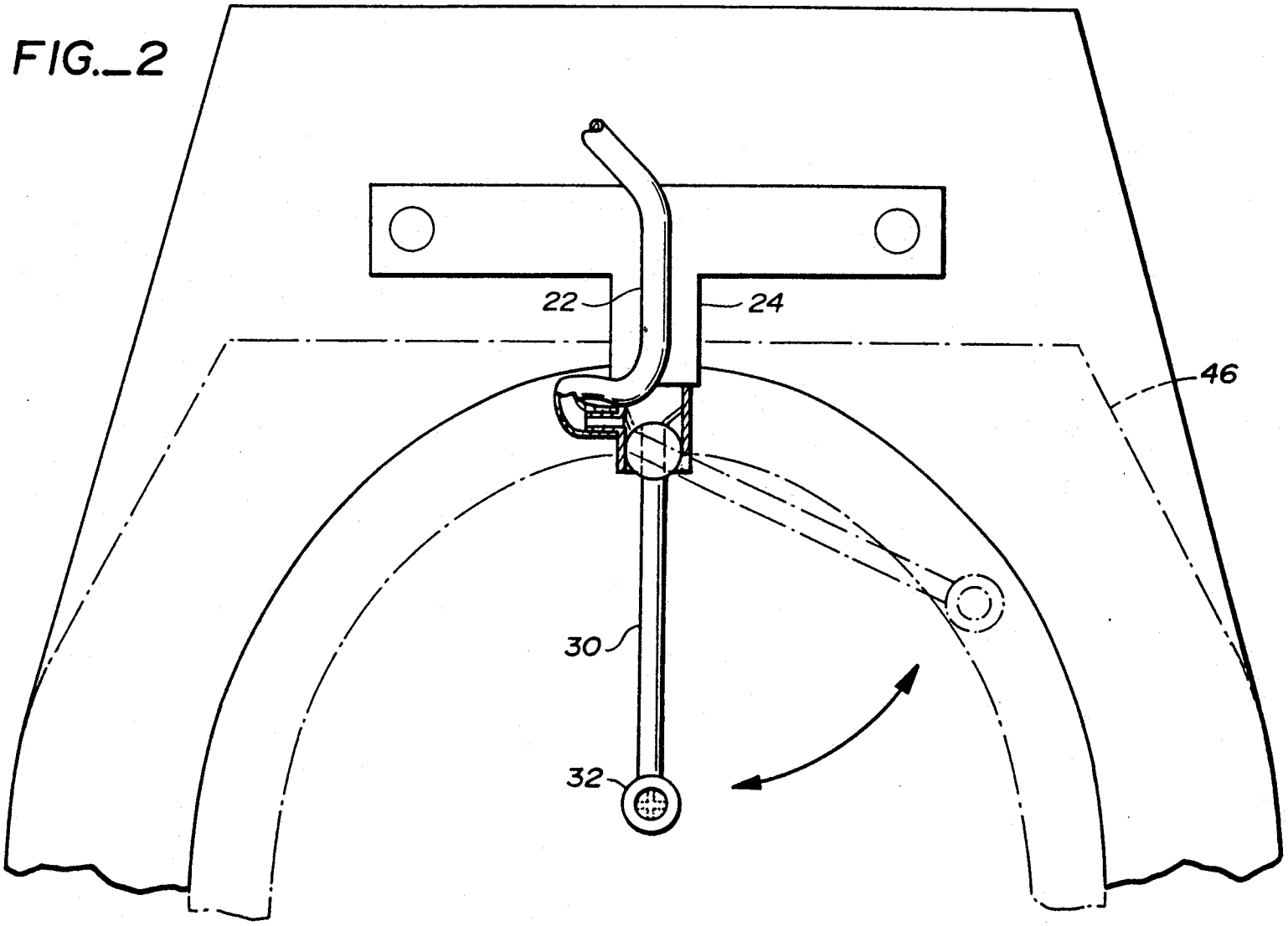
FIG. 2 is a partially cutaway top plan view of the bidet arm and bidet nozzle of the toilet bidet of this invention, illustrating their active position in the center of the toilet bowl, with their inactive position adjacent the side of the toilet bowl illustrated in phantom lines.

FIG. 2 is a partially cutaway top plan view of the bidet arm 30 and bidet nozzle 32 of the toilet bidet of this invention, illustrating their active position in the center of the toilet bowl, with their inactive position adjacent the side of the toilet bowl illustrated in phantom lines. The bracket housing 24 preferably mounts beneath existing toilet seat 46, so as not to interfere with normal operation of the toilet. The mechanism by which the bidet arm pivots upon water delivery may comprise an angularly inclined mounting (such that the bidet arm pivots around and up the incline due to water pressure upon water delivery, and falls back down the incline when water delivery ceases), a spring mounting (such that water pressure greater than the spring tension urges the bidet arm to pivot to the center), or any other appropriate structure.

Figure 3:
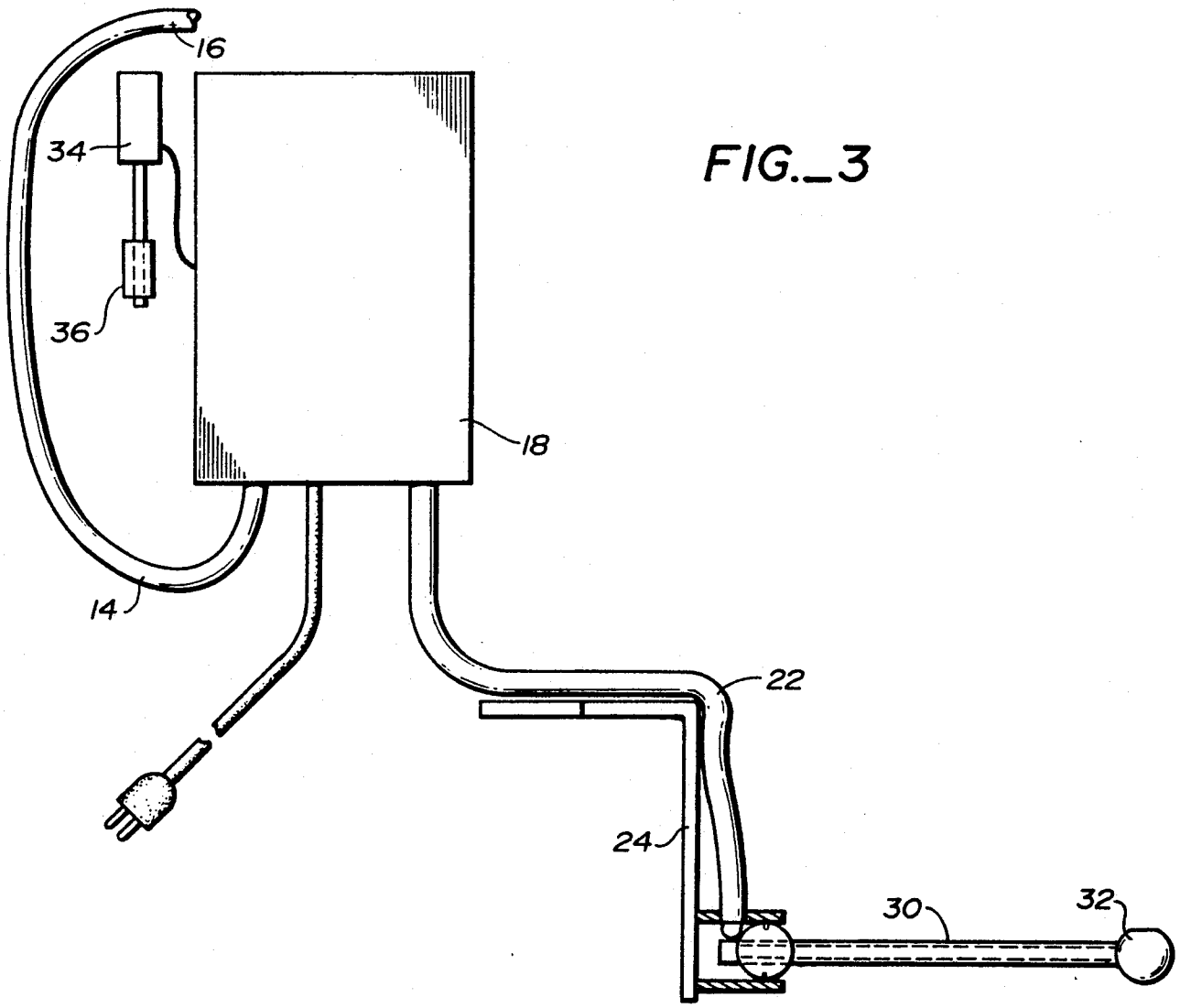
FIG. 3 is a partially cutaway side elevation view of the operative components of the toilet bidet of this invention.

FIG. 3 is a partially cutaway side elevation view of the operative components of the toilet bidet of this invention. This view illustrates the system on, with water flowing through delivery hose 22 to extend bidet arm 30.

Figure 4:
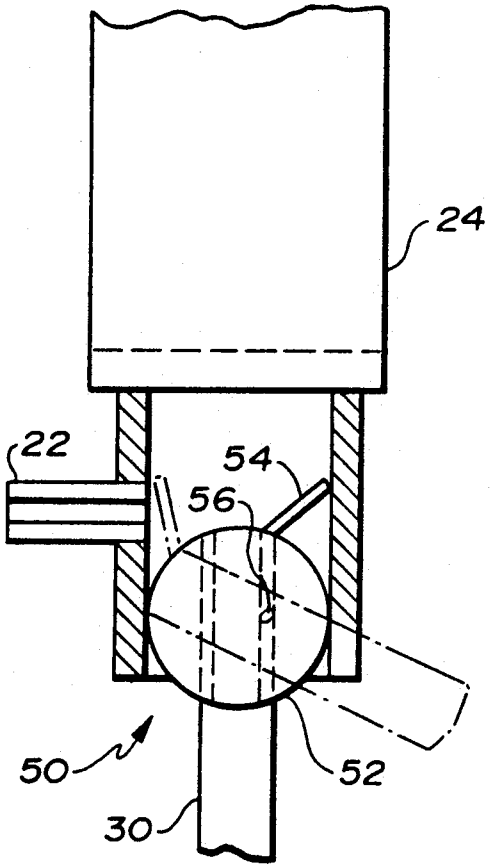
FIG. 4 is a top plan view of in partial cross-section of the bidet arm pivot within the bracket housing.

FIG. 4 is a top plan view of in partial cross-section of the bidet arm pivot 50 within the bracket housing. In the preferred embodiment, bidet arm pivot 50 comprises a pivotable ball 52 surrounding bidet arm 30 and bearing a splash plate or flange 54. When water is delivered via delivery hose 22, the stream of water contacts splash plate 54 and moves ball 52 about inclined axis 56, thereby moving the bidet arm 30 to the center of the toilet bowl, and delivering water through the bidet arm and nozzle to the user. When water delivery ceases, the weight of the bidet arm 30 causes the ball to pivot back (downhill) about inclined axis 56.

Figure 5:
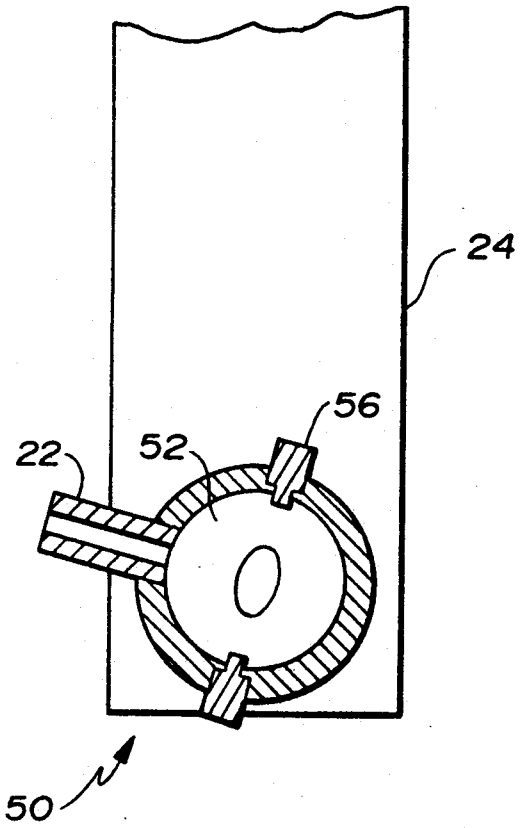
FIG. 5 is a front elevation partial cross-sectional view of the bidet arm pivot within the bracket housing, this view better illustrating the inclined axis of the pivot.

FIG. 5 is a front elevation partial cross-sectional view of the bidet arm pivot 50 within the bracket housing 24. Inclined axis 56 causes ball 52 to rotate in response to water delivery from delivery hose 22 against the splash plate (not visible in this view), and return to the rest position illustrated when water delivery ceases.

While this invention has been described in connection with preferred embodiments thereof, it is obvious that modifications and changes therein may be made by those skilled in the art to which it pertains without departing from the spirit and scope of the invention. For example, the heating unit is not mandatory for the inventive device to operate as a bidet, so that especially in warm climates (or areas with otherwise non-frigid normal water supplies) the device may be installed directly to the filler tube, without the heating unit. Accordingly, the scope of this invention is to be limited only by the appended claims.

What is claimed as invention is:

1. A toilet bidet for connection to a toilet fixture having a toilet tank, toilet bowl, and filler tube, said toilet bidet comprising:

a cold water supply hose conditioned for attachment to said filler tube;

a heating unit connected to said cold water supply hose, said heating unit conditioned for mounting to said toilet tank;

a warm water delivery hose connected to said heating unit;

a bracket housing connected to said warm water delivery hose; said bracket housing conditioned for mounting to said toilet bowl;

a bidet arm connected to said bracket housing, said bidet arm including a bidet nozzle; and a switch member including a float switch, said switch member connected to said heating unit, wherein when said toilet fixture is flushed, said float switch activates said heating unit, said filler tube delivers water through said cold water supply hose to said heating unit, and said heating unit delivers heated water through said warm water delivery hose to said bracket housing and said bidet arm for delivery through said bidet nozzle.

2. The toilet bidet of claim 1 wherein said bidet arm is pivotable within said bracket housing, and further including means for moving said bidet arm so that when water is delivered to said bidet arm, said bidet arm is urged towards the center of said toilet bowl, and when no water is delivered to said bidet arm, said bidet arm returns back towards the side of said toilet bowl.

* * * * *